United States Patent [19]

Fulton

[11] 3,933,246

[45] Jan. 20, 1976

[54] CONTAINER

[76] Inventor: Edward W. Fulton, c/o The Alan I. W. Frank Corp., Exton, Pa. 19341

[22] Filed: Dec. 24, 1974

[21] Appl. No.: 536,067

Related U.S. Application Data

[63] Continuation of Ser. No. 312,533, Dec. 6, 1972, abandoned.

[52] U.S. Cl. ..... 206/520; 220/70; 229/1.5 B

[51] Int. Cl.[2] ..... B65D 21/02

[58] Field of Search ..... 206/519, 520; 229/1.5 B; 220/70

[56] References Cited

UNITED STATES PATENTS

| | | | |
|---|---|---|---|
| 3,363,820 | 1/1968 | Schilling | 206/520 |
| 3,384,230 | 5/1968 | Mustee | 206/519 |
| 3,441,192 | 4/1969 | Metzler | 206/519 |
| 3,843,005 | 10/1974 | Uhlig | 220/70 |

*Primary Examiner*—George E. Lowrance

[57] ABSTRACT

A generally circular container of generally cup shape having a side wall and a bottom wall, the side wall in axial cross section of the container being at its upper portion straight and extending at an angle inwardly in the downward direction relatively to the axis of the container or perhaps more aptly defined as an inverted frusto-conical portion of uniform thickness and being at its lower portion curved downwardly and inwardly or defining a curvilinear surface of progressively decreasing diameter, the lower portion of the side wall being of uniform thickness equal to the thickness of the upper portion of the side wall, the lower portion of the side wall merging into the bottom wall of planar disciform configuration merged to the side wall by a smooth rounded curved juncture, the container having an annular, dependent foot extending downwardly from the bottom wall spaced inwardly from the lower extremity of the side wall. The upper portion of the side wall is preferably of somewhat greater vertical extent than the lower portion of the side wall and the vertical dimension of the depending foot is such that when two or more containers are nested the side walls are slightly spaced. The lower portion of the side wall desirably merges into the bottom wall at a curved corner which is tangent to the bottom of the container, such curved corner defining an arc of a circle of substantially less radius than that of the lower portion of the side wall.

5 Claims, 2 Drawing Figures

CONTAINER

Figure 1:
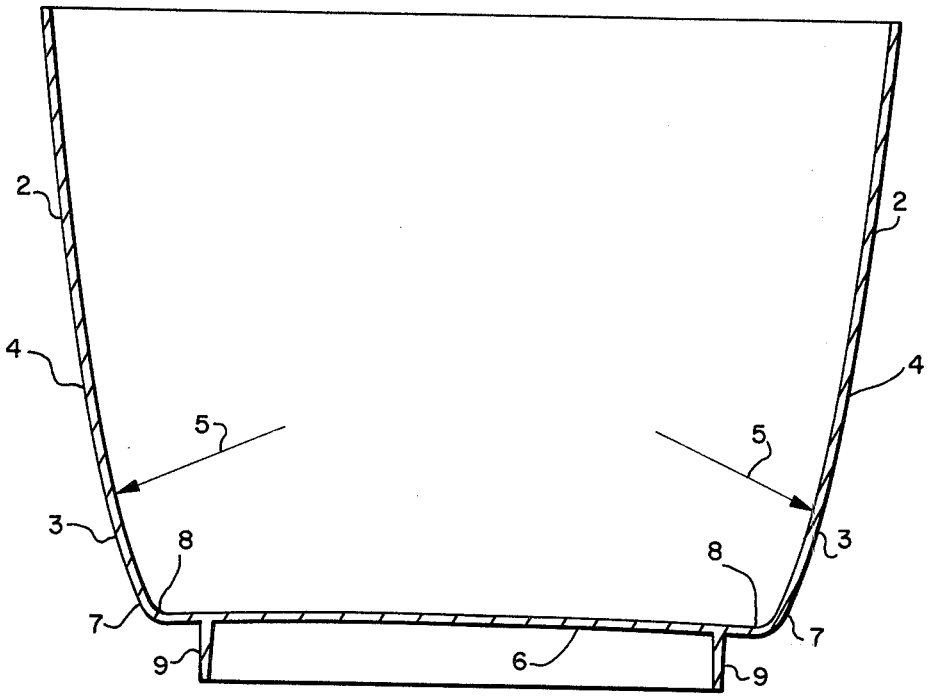

This application is a continuation of my copending application Ser. No. 312,533, filed Dec. 6, 1972, now abandoned.

The bottom of the container desirably has a circular flange-like or cylindrical foot extending downwardly therefrom spaced inwardly from the lower extremity of the side wall. The vertical height of the downwardly extending foot may be of the order of one-tenth of the total vertical height of the container and is preferably such that when the container is nested in an identical container a small clearance exists between the outside of the upper portion of the container and the inside of the upper portion of the identical container in which it is nested.

This invention relates to containers and particularly to a cup- or dish-shaped container of generally circular shape. The container has a number of novel features which contribute to its utility. The container has a side wall and a bottom wall, the side wall in axial cross section of the container being at its upper portion straight or inverted frusto conical and extending at an angle inwardly in the downward direction relatively to the axis of the container and being at its lower portion curved downwardly and inwardly forming a curvilinear surface of progressively decreasing diameter, the upper portion of the side wall being tangent to the lower portion of the side wall, the lower portion of the side wall merging into the bottom wall in a smooth rounded curve, the container having a circular flange-like foot extending downwardly from the bottom wall spaced inwardly from the lower extremity of the side wall. The upper portion of the side wall is preferably of somewhat greater vertical extent than the lower portion of the side wall. In a form of container suitable for use as a drinking cup the thickness of the side wall is desirably of the order of 0.03 inch. The curve of the lower portion of the side wall is preferably an arc of a circle. The lower portion of the side wall desirably merges into the bottom wall at a curved corner which is tangent to the bottom of the container. Such curved corner may be an arc of a circle of less radius than that of substantially the lower portion of the side wall.

The bottom of the container desirably has a circular flange-like foot extending downwardly therefrom spaced inwardly from the lower extremity of the side wall. The vertical height of the downwardly extending flange-like foot may be of the order of one-tenth of the total vertical height of the container and is preferably such that when the container is nested in an identical container a small clearance exists between the outside of the upper portion of the container and the inside of the upper portion of the identical container in which it is nested.

Among the advantages of my novel container are the following:

1. The side wall structure with the upper portion of the side wall straight and the lower portion curved provides for greater strength than a straight side wall having the same amount of material.

2. Because of the strength of the side wall structure of the container the conventional lip strengthening ring or lip bead can be eliminated resulting in more natural functional and pleasing mouth-to-cup relationship.

3. The straight and curved side wall structure provides for an improved natural functional and pleasing grip of the hand holding the cup.

4. The side wall structure provides for the same volume as a straight walled container with less height and greater width resulting in a more stable container and at the same time containing the liquid in a more practical serving shape. 5. My container has improved nestability, i.e., such containers may be nested within one another with a maximum conservation of space yet without binding; a clearance between the upper portions of the inner and outer nested containers is provided for.

6. The shape of the container is such as to eliminate corners for sugar and other matter to lodge in and provides for improved stirring and mixing.

Other details, objects and advantages of the invention will become apparent as the following description of a present preferred embodiment thereof proceeds.

Figure 2:
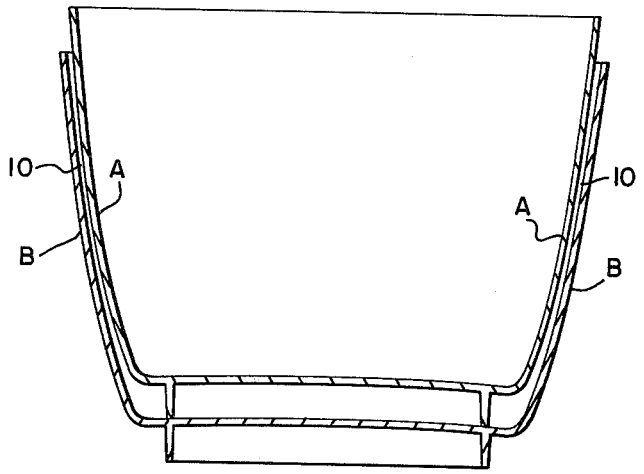

In the accompanying drawings I have shown a present preferred embodiment of the invention in which FIG. 1 is an axial cross-sectional view through my improved container and FIG. 2 is a similar view to reduced scale showing one of my containers nested in another thereof.

Referring now more particularly to the drawings, the container shown is in the form of a drinking glass and is fabricated out of clear polystyrene, although other material may be employed. In the form of container shown, which is of generally circular shape, the side wall of the container has an upper portion 2 and a lower portion 3. In axial cross section of the container the upper portion 2 and a lower portion 3. In axial cross section of the container the upper portion 2 of the side wall is straight and extends at an angle inwardly in the downward direction relatively to the axis of the container, or alternatively may be defined as an inverted frusto-conical wall portion of uniform thickness, the angle between the upper portion 2 of the side wall and the vertical in the form shown being 8°. The lower portion 3 of the side wall is curved downwardly and inwardly or can be defined more emphatically as a curvilinear surface of progressively decreasing diameter, and the upper portion 2 of the side wall is tangent to the lower portion 3 thereof at their juncture. In the form shown the thickness of the side wall is of the order of 0.03 inch. Also in the form shown the upper portion 2 of the side wall is of somewhat greater vertical extent than the lower portion 3 of the side wall. The upper portion 2 of the side wall is tangent to the lower portion 3 thereof at the point 4. The curve of the lower portion 3 of the side wall is shown as being arc of a circle indicated by the arrow 5. The lower portion 3 of the side wall merges into the planar disciform bottom wall 6 of the side wall at a curved corner juncture 7 which is tangent to the bottom 6 of the side wall. In the form shown the curved corner 7 is a arc of a circle of substantially less radius than that of the lower portion 3 of the side wall. The radius of such circle arc is indicated by the reference numeral 8.

The bottom 6 of the container has a circular flange-like or dependent cylindrical foot 9 extending downwardly from the under surface of the disciform bottom wall 6 and spaced inwardly from the lower extremity of the side wall of the container. The vertical height of the downwardly extending flange-like foot 9 is of the order of one-tenth of the total vertical height of the container and is such that when the container is nested in an identical container as shown in FIG. 2 a small clearance exists between the outside of the upper portion of the container and the inside of the upper portion of the identical container in which it is nested. In FIG. 2 the inner container is designated A and the outer container is designated B. These containers are of the same form as that shown in FIG. 1. When they are nested there is always a small clearance therebetween as shown at 10 in FIG. 2.

The advantages of my invention have been set forth above. While a container in the form of a drinking cup has been shown in the drawings for purposes of illustration, the container may assume various other forms within the purview of the invention and within the scope of the following claims.

I claim:

1. A container of generally circular shape defining a generally cup-shaped article including an inverted frusto-conical upper side wall portion of uniform thickness throughout; a lower side wall portion also of the same uniform thickness as that of the upper side wall portion, said lower side wall portion defining a curvilinear surface of progressively decreasing diameter; a flat, disciform bottom wall merging with the lowermost part of said curvilinear side wall portion at smoothly curved juncture having a radius of curvature substantially less than that of said curvilinear bottom portion of said side wall, said bottom wall being of identical uniform thickness as that of said side wall portions; the bottom wall having a dependent cylindrical foot formed integrally therewith, the diameter of said dependent foot being less than the diameter of said disciform bottom wall and the vertical height of said dependent foot being such that when two or more containers are nested the side wall of the uppermost container is slightly spaced from the inner surface of the side wall of the lowermost container.

2. A container of generally circular shape as defined in claim 1 in which the upper portion of the side wall is of somewhat greater vertical extent than the lower portion of the side wall.

3. A container of generally circular shape as defined in claim 1 in which the thickness of the side bottom walls is of the order of 0.03 inch.

4. A container of generally circular shape as defined in claim 1, wherein said dependent foot is on the order of 1/10 the overall vertical height of the container.

5. A container as defined in claim 2 wherein the vertical height of the dependent cylindrical foot is on the order of one tenth the overall vertical height of the container.

* * * * *

UNITED STATES PATENT OFFICE

CERTIFICATE OF CORRECTION

Patent No. 3,933,246 Dated January 20, 1976

Inventor(s) Edward W. Fulton

It is certified that error appears in the above-identified patent and that said Letters Patent are hereby corrected as shown below:

Column 1, cancel the paragraph at lines 8-18;

Column 1, line 30, after "wall" insert -- at the break or direction change juncture of these side wall portions--, line 45, at the end of the line, cancel "substantially".

Column 2, line 8, begin a new paragraph with --5.--;

lines 33 and 34, cancel "and a lower portion 3. In axial cross section of the container the upper portion 2".

Column 4, claim 3, line 2, after "side" insert -- and --.

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*